US005389910A

United States Patent [19]

Abel

[11] Patent Number: 5,389,910

[45] Date of Patent: Feb. 14, 1995

[54] SOLENOID ENCASEMENT WITH VARIABLE RELUCTANCE

[75] Inventor: Steve G. Abel, Chandler, Ariz.

[73] Assignee: AlliedSignal Inc., Morris Township, Morris County, N.J.

[21] Appl. No.: 986,960

[22] Filed: Dec. 8, 1992

[51] Int. Cl.[6] ..... H01F 7/00; H01F 7/08

[52] U.S. Cl. ..... 335/278; 335/238; 335/237

[58] Field of Search ..... 335/278, 236, 237, 238, 335/285, 286, 288, 298, 304

[56] References Cited

U.S. PATENT DOCUMENTS

| | | | |
|---|---|---|---|
| 2,442,016 | 5/1948 | Poole | 335/237 |
| 3,113,251 | 12/1963 | Moser | 335/237 |
| 3,673,529 | 6/1972 | Garratt | 335/234 |
| 3,747,892 | 7/1973 | Gigantino et al. . | |
| 4,004,258 | 1/1977 | Arnold . | |
| 4,507,634 | 3/1985 | Vanderlaan . | |
| 4,610,428 | 9/1986 | Fox | 251/129.16 |
| 4,630,799 | 12/1986 | Nolan et al. . | |
| 4,641,812 | 2/1987 | Vanderlaan et al. . | |
| 4,690,371 | 9/1987 | Bosley et al. . | |
| 4,709,619 | 12/1987 | Bartholomaus et al. . | |
| 4,988,074 | 1/1991 | Najmolhoda . | |

*Primary Examiner*—Leo P. Picard
*Assistant Examiner*—Stephen T. Ryan
*Attorney, Agent, or Firm*—Robert A. Walsh

[57] ABSTRACT

A solenoid apparatus compises an encasement defining a longitudinal axis. The reluctance of the encasement is variable by movement of a potion of the encasement relative to the longitudinal axis.

9 Claims, 2 Drawing Sheets

FIG. 5
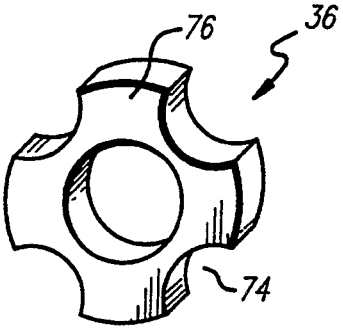
FIG. 2
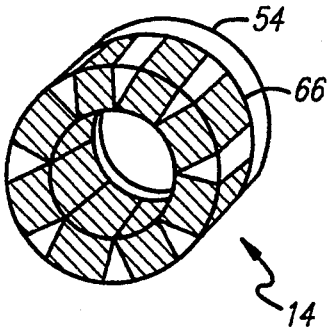
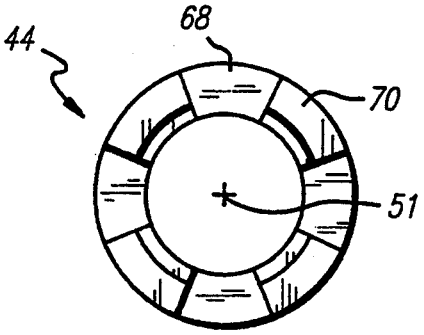
FIG. 3
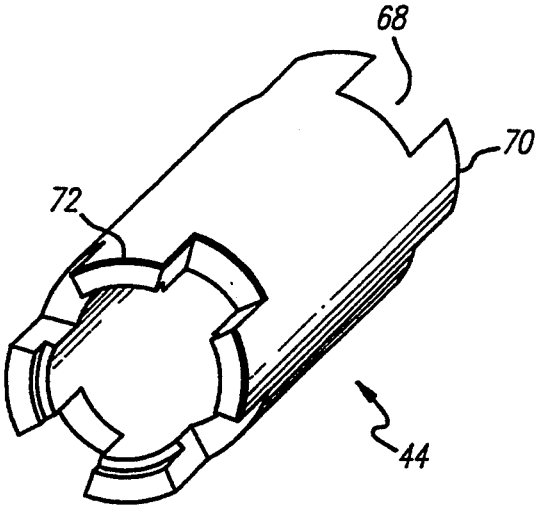
FIG. 4
FIG. 6(a)
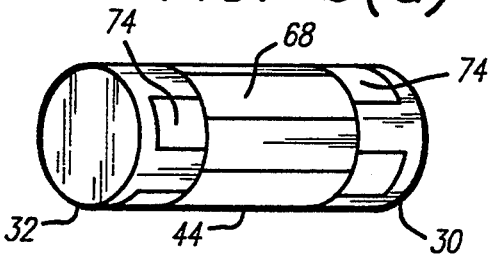
FIG. 6(b)
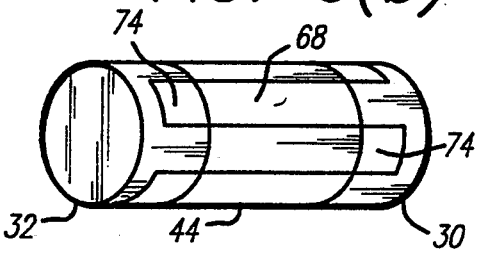
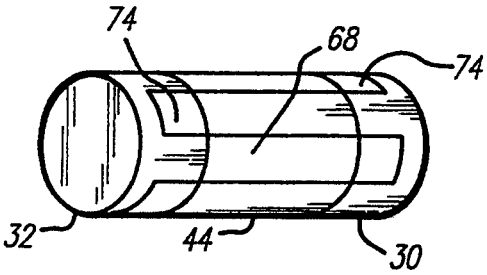
FIG. 6(c)

SOLENOID ENCASEMENT WITH VARIABLE RELUCTANCE

TECHNICAL FIELD

This invention relates generally to solenoid devices such as linear electric motors and valves. More specifically, the invention relates to the encasement of such devices, wherein the encasement forms part of a magnetic circuit. Yet more specifically, the invention relates to a solenoid encasement adapted to provide variable reluctance in the circuit.

BACKGROUND OF THE INVENTION

Solenoid devices that use their encasement in magnetic circuits are widely known. An exemplary version is illustrated in U.S. Pat. No. 4,004,258 Arnold wherein the encasement 12 serves as a component of two magnetic circuits 19,21. Such devices are particularly useful as valve actuators in applications which demand a latching function. A problem in such applications is that if electrical power is lost in the system used to excite the coils of the solenoid device, the position of the armature (and, by extension, the position of the valve) is fixed and cannot easily be changed without restoration of power.

The primary objective of the present invention is to provide a solution to the above-described problem.

Other objectives and advantages of the invention may become apparent from the following description, which includes the appended claims.

SUMMARY OF THE INVENTION

The invention achieves the above-stated objective by providing a solenoid device with an encasement having variable magnetic reluctance, wherein the reluctance is variable by relative movement of a movable portion of the encasement.

BRIEF DESCRIPTION OF THE DRAWINGS

FIG. 2 is a perspective view of a permanent magnet structure included in the device of FIG. 1.

FIG. 3 is an end view of the relatively movable portion of the solenoid encasement.

FIG. 4 is a perspective view of the movable portion partially shown in FIG. 3.

FIG. 5 is a perspective view of a pole piece incorporated in the device of FIG. 1.

FIGS. 6 (*a–c*) are schematic drawings employed to illustrate use of the invention as embodied in FIGS. 1–5.

Figure 1:
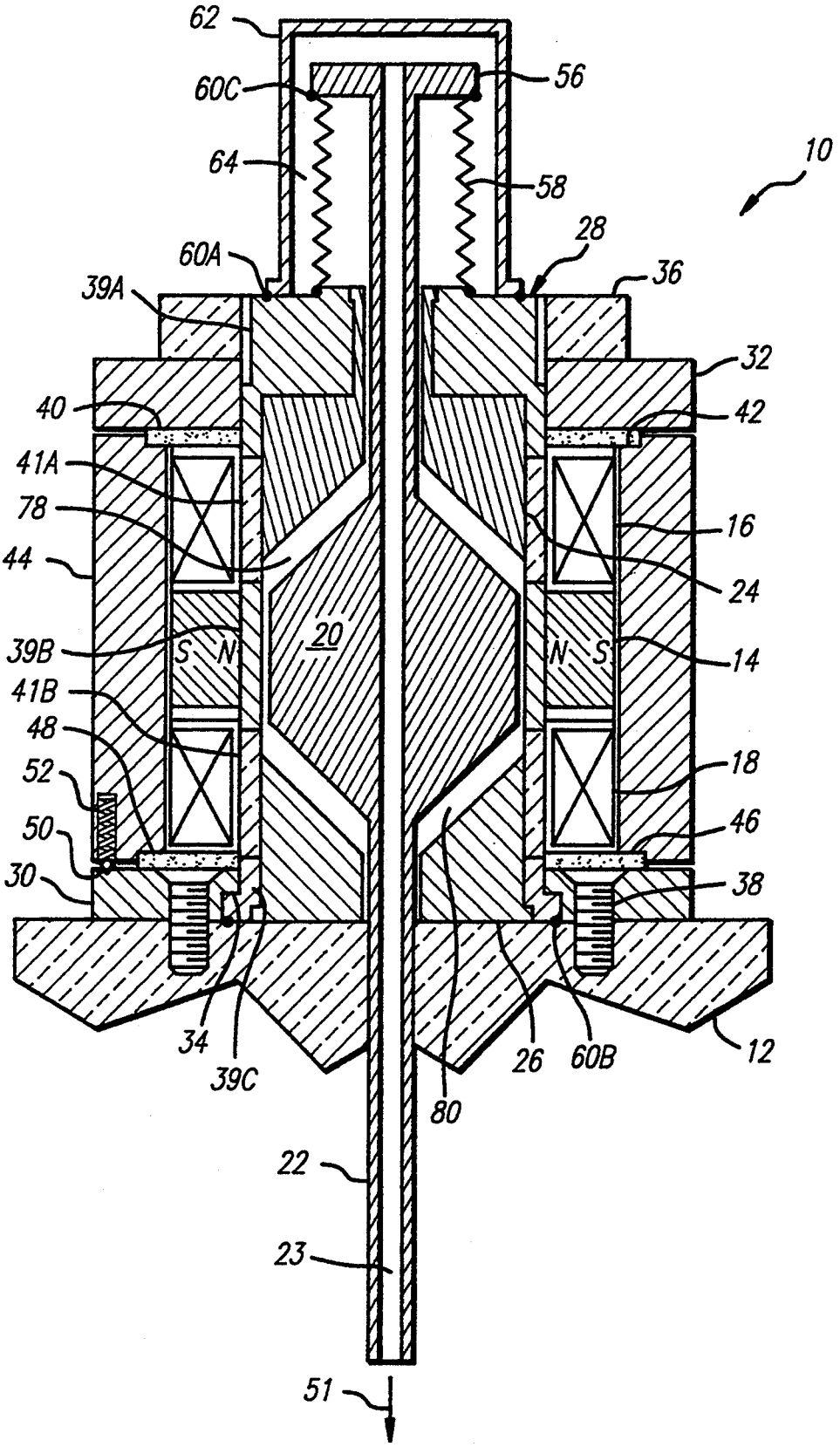
FIG. 1 is a sectional view of a solenoid device incorporating the invention.

All information contained in the drawings is incorporated herein by reference thereto, as though provided in textual form.

DESCRIPTION OF THE PREFERRED EMBODIMENT

In FIG. 1, the number 10 designates a generally cylindrical solenoid device that is shown attached to a valve body 12, the latter being only partially illustrated.

The interior of the solenoid 10 is comprised of a permanent magnet 14 interposed between two coils or windings 16, 18, and a ferromagnetic armature 20 which includes or is rigidly connected to an actuating rod 22. In the illustrated embodiment, the rod 22 has an axial bore 23 formed therethrough. The coils 16, 18 are wound in a common direction. Leads for the coils 16, 18 extend to an external connector (not shown) which connects the coils in series. The armature 20 is shown in an unstable position that, in use, it would occupy only transitorily in moving from one latched position to another. The actuating rod 22 extends into the valve body 12 and in use opens or closes a valve as needed. Movement of the armature 20 is limited by ferromagnetic stops 24, 26, which fix the forementioned latched positions. The stops 24, 26 are fitted into a centrally-disposed interior canister 28 and a ferromagnetic first pole piece 30. The canister 28 is circumscribed by a ferromagnetic second pole piece 32 and is held to the valve body 12 by a step 34 formed on the first pole piece 30. The canister 28 is threaded near its top end to receive a retaining nut 36. Bolts (as at 38) extending through the first pole piece 30 fasten the entire solenoid 10 to the valve body 12.

The canister 28 is essentially a stepped cylinder formed by brazing or welding together ferromagnetic portions **39*a*, 39*b*, 39*c* and non-conductive portions 41*a*, 41*b* as indicated This structure, in combination with weldments 60*a* and 60*b*, can be used to provide a hermetically sealed interior for the solenoid device 10. In the illustrated embodiment, however, air enters the interior via clearance (not shown) between the actuating rod 22 and the valve body 12**.

The second pole piece 32 abuts a first swivel bushing 40. The bushing 40 bears against an upper land 42 formed on a movable portion 44 of the solenoid encasement. A second swivel bushing 46 is seated in a recess (not shown) formed in the first pole piece 30, and bears against a lower land 48 formed on the movable portion 44.

Formed in the first pole piece 30 are three slots (as at 50) spaced at 22½ degrees. (Note: Angular specifications provided herein are determined by reference to the longitudinal axis 51 of the movable portion 44.) Installed in the movable portion 44 is a ball/spring mechanism 52. The slots 50 and the ball/spring mechanism 52 cooperate to form a conventional detent coupling which maintains the movable portion 44 at a fixed rotational position, but which yields to permit rotation of the same in response to manually applied torque.

In the illustrated embodiment, the actuating rod 22 has an extended length and includes a terminal flange 56. A bellows structure 58 is connected via weldments (as at **60*c*) to the flange 56 and the second pole piece 32. Encasing the bellows 58 and the extended portion of the actuating rod 22 is a cylindrical member 62 which is welded to the canister 28 to form a plenum 64. In the contemplated application, the armature 20 is used to actuate a linearly movable valve element such as a spool or popper. The valve element has a diameter equal to the effective diameter of the bellows 58. Fluid at upstream pressure of the valve is routed through the bore 23 to the plenum 64. Fluid at downstream pressure is routed through the forementioned clearance between the rod 22 and valve body 12, around the armature 20, and into the interior of the bellows 58. This distribution of pressure acting on opposing but equal areas serves to pressure balance the actuating rod 22**, thus reducing the required actuating force.

The permanent magnet 14, illustrated in FIG. 2, is of a conventional design in which a plurality of adjacent rectangular magnets (as at 66) are secured in an aluminum cage 54 as indicated. When assembled, the structure as a whole provides radial magnetization. In the drawing, the cross-hatching of the magnets 66 is intended merely to show a difference of material, and should not be interpreted as a sectional view of the magnets.

The movable portion 44 of time encasement is more particularly illustrated in FIGS. 3 and 4, to which attention is now directed. The movable portion 44, like the pole pieces 30, 32 can be made of any ferromagnetic material suitable for the environment in which the solenoid is used. From that material, certain regions (as at 68) are removed by any suitable machining process. These then become regions of high magnetic reluctance (NOTE: filling the vacant regions with a non-conductive material which can be joined to the ferromagnetic material will produce the same result). Looking at FIGS. 3 and 4, it can be seen that each end of the movable portion 44 forms alternating regions of high magnetic reluctance (as at 68) and low magnetic reluctance (as at 70). Preferably, these regions each span an arc of 45 degrees, determined at each edge (as at 72) of the movable portion 44.

Similarly, and referring now to FIG. 5, each of the pole pieces 30, 32 is formed to provide alternating regions of high magnetic reluctance (as at 74) and low magnetic reluctance (as at 76).

The schematic views of FIG. 6 best illustrate the principle of the invention. In FIG. 6 (*a*), regions 68 are equally out of angular phase (22½°) with regions 74, so that magnetic reluctance/susceptance associated with fields produced by the coils 16, 18 is equal. Note that the stationary pole pieces 30, 32 are forty-five degrees out of angular phase. In FIG. 6(*b*), the regions 68 are in angular phase with the regions 74 of the second pole piece 32, but are 45 degrees out of phase with the equivalent regions of the first pole piece. Accordingly, magnetic reluctance in a flux path extending from the second pole piece 32 and along the movable portion 44 is low, while reluctance in a flux path extending from the first pole piece and along the movable portion is very high. Conversely, the relative reluctance along the forementioned flux paths is reversed in FIG. 6(*c*).

The positions of the movable portion 44 represented in FIGS. 6(*a–c*) correspond to the three positions at which the slots 50 for the detent coupling are formed in the first pole piece 30.

It should be understood that the movable portion 44 can be reconfigured so that the regions 68 at one end are 45 degrees out of phase with the functionally equivalent regions at the opposite end. In that case, the first and second pole pieces 30, 32 would be positioned so that their functionally equivalent regions are in angular phase.

Actuation of the solenoid 10 is controlled by magnetic flux, electromagnetic flux, and the reluctance of the various flux paths involved. The magnet 14 is polarized to cause flux to flow radially inward along a path which can be considered as extending through the magnet and portion 39*b*, into the armature 20 across the indicated gap (greatly exaggerated in the drawing), outward from the armature across each working gap 78, 80 (upward through the top gap 78 and downward through the bottom gap 80) and into the respective stops 24, 26, through the respective portions 39*a*, 39*c* of the canister 28 and the respective pole pieces 32, 30, across the very small gaps, indicated between the pole pieces and the movable member 44, and finally along the movable member, across the small indicated gap between the movable member and the magnet, and back into the magnet. With current of positive polarity applied to the coils 16, 18, the electromagnetic flux flows upward through the armature 20 and downward through the movable member 44. With current of negative polarity applied to the coils 16, 18, the electromagnetic flux flows downward through the armature 20 and upward through the movable member 44.

For normal electrical operation, the movable member 44 is located in the neutral position indicated in FIG. 6*a*. If the armature 20 is initially latched in the downward position (i.e. the armature 20 abuts the stop 26) and upward actuation is required, then positive current is applied to the coils 16, 18. This produces additive flux in the upper gap 78, and reduced flux in the lower path extending through the first pole piece 30. The higher flux density in the path extending through the second pole piece 32 forces the armature 20 upward until it abuts the stop 24, and the applied current is discontinued. To actuate downward, the process is repeated in reverse, with negative current applied to the coils 16, 18.

For manual non-electrical operation, the movable member 44 of the encasement is used. If the armature 20 is initially latched in the downward position and upward actuation is required, the movable member 44 is rotated from the position indicated in FIG. 6*a* to the position indicated in FIG. 6*b*. The reluctance attributable to complete misalignment of the regions 68 of the movable member 44 with the regions 74 of the first pole piece 30 lowers flux density in the lower gap 80. Conversely, the increased permeability attributable to alignment of the regions 70 with the regions 76 of the second pole piece 32 increases flux density in the upper gap 78. Consequently, the armature 20 is actuated upward until it abuts the upper stop 24. The armature 20 will remain latched in the upward position so long as the movable member 44 is positioned as illustrated in FIG. 6*a* or FIG. 6*b*. To manually actuate the armature downward, the movable member 44 is rotated to the position illustrated in FIG. 6*c*.

The foregoing portion of the description is intended to serve a pedagogical purpose. The necessarily limited range of design alternatives described in this application is not intended to restrict the scope of the invention further than is just and reasonable in view of the teaching contained herein.

What is claimed is:

1. Solenoid apparatus comprising substantially a cylindrical shaped encasement thereof; the encasement having a longitudinal axis, two relatively fixed end portions, and variable reluctance; the reluctance being variable by movement of a movable portion located between the end portions of the encasement wherein the movement is rotational, and wherein each of the end portions forms a first set of circumferentially extending regions which are angularly spaced by a second set of circumferentially extending regions formed by the same end portion, the regions of the first set having relatively high magnetic reluctance and the regions of the second set having relatively low magnetic reluctance, the regions of the first set are of mutually equiangular range and are equivalent for the two end portions, and the end portions are out of angular phase, as determined by reference to the regions of the first set.

2. Solenoid apparatus as recited in claim 1 further comprising coupling means for yieldably maintaining the movable portion at a fixed rotational position relative to the axis and the end portions.

3. Solenoid apparatus as recited in claim 1 wherein the movable portion forms a first plurality of circumferentially extending regions which are angularly spaced by a second plurality of circumferentially extending regions formed by the movable portion, the regions of the first plurality having relatively high magnetic reluctance and the regions of the second plurality having relatively low magnetic reluctance.

4. Solenoid apparatus as recited in claim 3 wherein the regions of the first plurality are of mutually equiangular range and are of equiangular range with the regions of the first set of one of the two end portions.

5. Solenoid apparatus as recited in claim 3 wherein the movable portion forms a third plurality of circumferentially extending regions spaced from and equal in number to the first plurality, the regions of the third plurality having relatively low magnetic reluctance and being angularly spaced by a fourth plurality of circumferentially extending regions formed by the movable member and having relatively high magnetic reluctance.

6. Solenoid apparatus as recited in claim 5 wherein the regions of the third plurality are of mutually equiangular range and are of equiangular range and in angular phase with the regions of the first plurality.

7. Solenoid apparatus as recited in claim 6 wherein the regions of the first and second pluralities are adjacent to the regions of the first and second sets of one of the two end portions.

8. Solenoid apparatus as recited in claim 7 wherein the regions of the third and fourth pluralities are adjacent to the regions of the first and second set of the other of the two end portions.

9. Solenoid apparatus as recited in claim 8 further comprising coupling means for yieldably maintaining the movable portion at a fixed rotational position relative to the axis and the two end portions.

* * * * *

UNITED STATES PATENT AND TRADEMARK OFFICE

CERTIFICATE OF CORRECTION

PATENT NO. : 5,389,910

DATED : Feb. 14, 1995

INVENTOR(S) : Steve G. Abel

It is certified that error appears in the above-identified patent and that said Letters Patent is hereby corrected as shown below:

Column 1, line 4, insert

--GOVERNMENT RIGHTS

The invention described herein was made in the performance of work under a NASA Contract No. NAS8-50,000 and is subject to the provisions of Section 305 of the National Aeronautics and Space Act of 1958 (42 U.S.C. 2457).--

Signed and Sealed this

Sixth Day of June, 1995

*Attest:*

*Attesting Officer*

BRUCE LEHMAN

*Commissioner of Patents and Trademarks*